US006430383B1

(12) United States Patent
Sugiyama et al.

(10) Patent No.: US 6,430,383 B1
(45) Date of Patent: Aug. 6, 2002

(54) IMAGE TRANSFERRING DEVICE AND IMAGE FORMING APPARATUS INCLUDING THE SAME

(75) Inventors: Toshihiro Sugiyama, Tokyo; Hiroshi Ishii, Kanagawa; Hiroshi Saitoh, Chiba, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 day.

(21) Appl. No.: 09/692,191

(22) Filed: Oct. 20, 2000

(30) Foreign Application Priority Data

Oct. 22, 1999 (JP) ..... 11-301773

(51) Int. Cl.[7] ..... G03G 15/16; G03G 21/00

(52) U.S. Cl. ..... 399/101; 15/256.51

(58) Field of Search ..... 399/101, 313, 399/349, 357; 15/1.51, 256.5, 256.51, 256.52

(56) References Cited

U.S. PATENT DOCUMENTS 4,469,435 A * 9/1984 Nosaki et al. ..... 15/1.51 X
5,768,665 A 6/1998 Yamanaka et al. ..... 399/235
5,809,373 A * 9/1998 Yoda et al. ..... 399/101
6,035,157 A * 3/2000 Takahashi et al. ..... 399/101 X

FOREIGN PATENT DOCUMENTS

| | | | |
|---|---|---|---|
| JP | 6-35340 | | 2/1994 |
| JP | 9-152788 | | 6/1997 |
| JP | 10-39687 | * | 2/1998 |
| JP | 11-38777 | | 2/1999 |
| JP | 2954812 B2 | | 7/1999 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image transferring device for transferring a toner image from an image carrier to a recording medium includes a belt passed over a plurality of rotary bodies for supporting and conveying the recording medium and a cleaning member for cleaning the surface of the belt in contact therewith. A dielectric layer forms the surface of the cleaning member. An image forming apparatus including the above image transferring device is also disclosed.

14 Claims, 2 Drawing Sheets

IMAGE TRANSFERRING DEVICE AND IMAGE FORMING APPARATUS INCLUDING THE SAME

BACKGROUND OF THE INVENTION

The present invention relates to a copier, facsimile apparatus, printer or similar image forming apparatus. More particularly, the present invention relates to an image transferring device including an endless belt passed over a plurality of rotary bodies for conveying a recording medium and a cleaning member for cleaning the surface of the belt in contact therewith and transferring a toner image from an image carrier to a recording medium carried on the belt.

Generally, a copier, printer or similar image forming apparatus includes an image transferring device for transferring a toner image formed on an image carrier to a paper sheet or similar recording medium. One of conventional image transferring devices includes an endless belt passed over support rollers, or rotary bodies, and facing a photoconductive element or image carrier in an image transfer region. The belt conveys a paper sheet or similar recording medium to the image transfer region. At this instant, an electric field formed in the image transfer region transfers a toner image formed on the photoconductive element to the recording medium.

In the above-described convention image transferring device, the belt and photoconductive element contact each other with the intermediary of the paper sheet. It is therefore likely that toner deposited on the background of the photoconductive element or scattered around in the event of image transfer deposits on the belt, bringing about the offset of paper sheets or defective image transfer. To solve this problem, cleaning means for removing the toner undesirably deposited on the belt is essential.

Japanese Patent Laid-Open Publication Nos. 7-64444 and 9-152788, for example, each disclose an electric field type of cleaning means using a cleaning member implemented by a conductive member. A cleaning bias opposite in polarity to a charge deposited on toner is applied to the cleaning member. The cleaning member slidingly contacts the surface of the belt, causing the toner to electrostatically move from the belt toward the cleaning member. In this type of cleaning means, an electric field that causes the toner to move toward the conductive member away from the belt (bias electric field hereinafter) is formed between the conductive member and the belt.

The electric field type of cleaning means, however, cannot achieve sufficient performance and sometimes fails to fully clean the belt. This is particularly true when the belt has a volume resistivity of $10^{12}$ Ωcm to $10^{13}$ Ωcm or above or when a great amount of charge deposits on the toner.

Specifically, dielectric polarization occurs more easily with a belt having high resistance than with a belt having low resistance. This, coupled with the fact that a belt with high resistance easily retains a charge applied thereto during image transfer and opposite in polarity to the charge of the toner, intensifies a force electrostatically attracting the toner onto the belt. When a great amount of charge deposits on the toner, the attraction electrostatically attracting the toner onto the belt also increases due to a Coulomb's force or an image force. The toner deposits on the belt in the form of layers. Therefore, if the electrostatic attraction acting between the toner and the belt is intense, even the toner in an upper layer sometimes fail to move toward the conductive member despite the electric field. In light of this, the cleaning bias to be applied to the conductive member may be increased in order to provide the cleaning means with a desirable cleaning ability even in the above condition.

However, an excessive cleaning bias is apt to cause dielectric breakdown to occur in the direction of thickness of the belt in the position where the cleaning member and belt contact each other, resulting in current leakage. As a result, the bias electric field is not formed and makes a sufficient cleaning ability unachievable. Moreover, an excessive cleaning bias is likely to inject a charge opposite in polarity to the toner into the toner existing on the belt and invert the polarity of the toner. The toner inverted in polarity cannot be removed by the electric field type of cleaning means and degrades the cleaning ability. In addition, the toner deposited on the background of the photoconductive element and inverted in polarity is apt to deposit on the belt when the former is brought into contact with the latter, also degrading the cleaning ability.

Technologies relating to the present invention are also disclosed in, e.g., Japanese Patent Laid-Open Publication Nos. 6-35340 and 11-38777 and Japanese Patent No. 2,954,812.

SUMMARY OF THE INVENTION

It is therefore an object of the present invention to provide an image transferring device capable of cleaning the surface of a belt more efficiently than the conventional electric field type of cleaning means even when the belt has high resistance or when a great amount of charge deposits on toner, while removing even toner inverted in polarity, and an image forming apparatus including the same.

In accordance with the present invention, an image transferring device for transferring a toner image from an image carrier to a recording medium includes a belt passed over a plurality of rotary bodies for supporting and conveying the recording medium and a cleaning member for cleaning the surface of the belt in contact therewith. A dielectric layer forms the surface of the cleaning.

Also, in accordance with the present invention, an image forming apparatus includes an image carrier, a toner image forming device for forming a toner image on the image carrier, and an image transferring device for transferring the toner image from the image carrier to a recording medium. The image transferring device includes a belt passed over a plurality of rotary bodies for supporting and conveying the recording medium and a cleaning member for cleaning the surface of the belt in contact therewith. A dielectric layer forms the surface of the cleaning member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
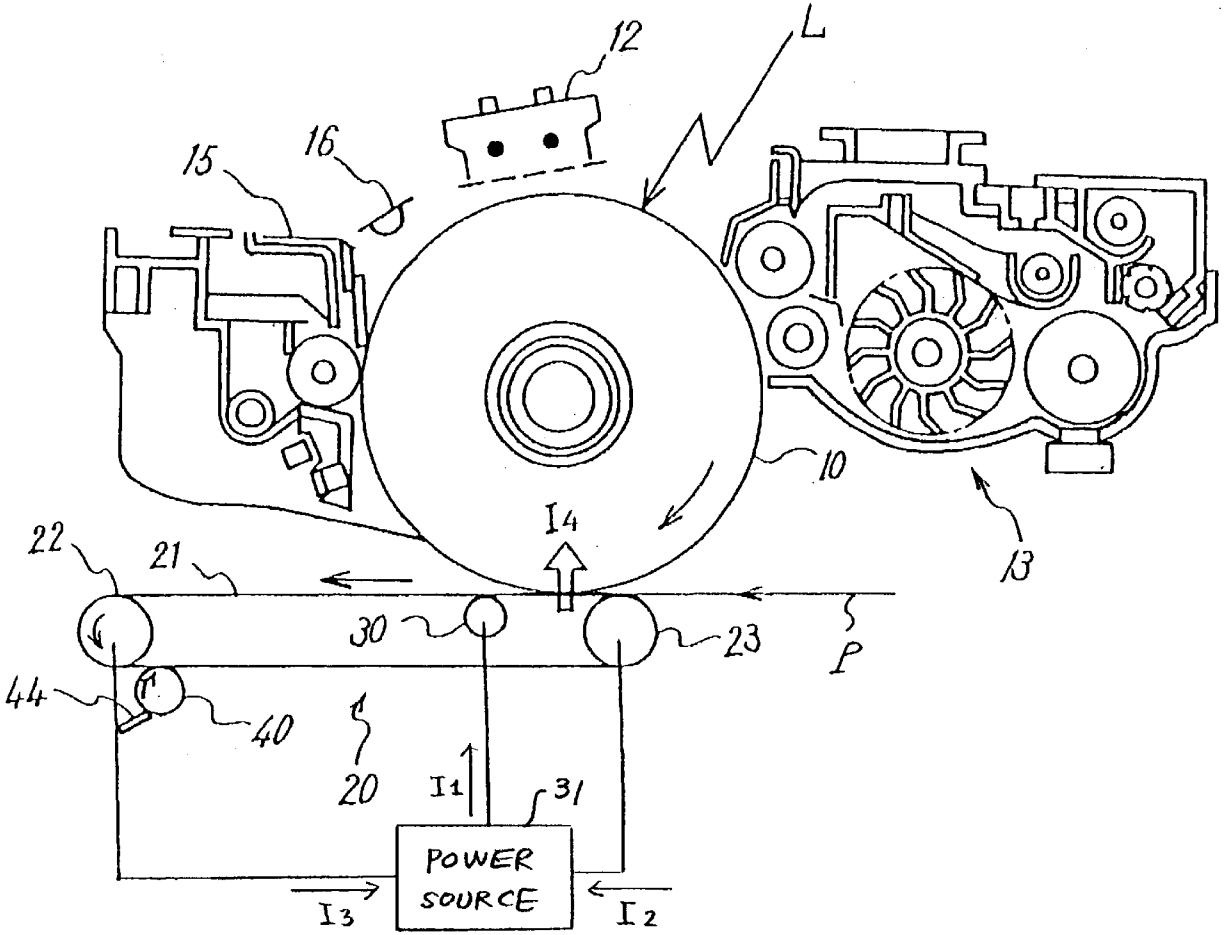
FIG. 1 is a view showing an image forming apparatus embodying the present invention.

Referring to FIG. 1 of the drawings, an image forming apparatus embodying the present invention is shown and implemented as an electrophotographic copier by way of example. As shown, the copier includes a photoconductive drum or image carrier 10 rotatable in a direction indicated by an arrow in FIG. 1. Arranged around the drum 10 are a charger 12, an exposing unit, not shown, a developing unit 13, a cleaning unit 15 and a discharger 16. The developing unit 13 plays the role of toner image forming means for forming a toner image on the drum 10. The discharger 16 is implemented by a discharge lamp.

An image transferring device 20 is arranged below the drum 10 and includes an endless belt 21 passed over a drive roller 22 and a driven roller 23, which are rotary bodies. The belt 21 is movable in a direction indicated by an arrow in FIG. 1 and conveys a paper sheet or similar recording medium P. The drive roller 22 and driven roller 23 are formed of metal or similar conductive material and connected to ground. A bias roller 30 and a cleaning roller or cleaning member 40 adjoin the belt 21. The cleaning roller 40 is held in contact with the surface of the belt 21 for cleaning it.

The belt 21 is formed of rubber and coated with a fluorine-containing material to have high resistance. Specifically, the belt 21 has volume resistivity of $10^{14}$ Ωcm. A lever, not shown, moves the belt 21 upward into contact with the drum 10 at the time of image transfer or moves it downward away from the drum 10 after image transfer.

A constant-current power source 31 is connected to the bias roller 30 for applying a current $I_1$ for image transfer to the roller 30. The bias roller 30 and power source 31 constitute charge applying means for applying to the belt 21 a positive charge opposite in polarity to a charge to deposit on toner. Part of the charge fed from the bias roller 30 to the belt 21 flows into the drive roller 22 and driven roller 23 and returns to the power source 31 as feedback currents $I_2$ and $I_3$. Also, in an image transfer region where the drum 10 and belt 21 face each other, an effective image transfer current $I_4$ that contributes to image transfer flow from the belt 21 to the drum 10. In the illustrative embodiment, to maintain the image transfer current $I_4$ constant, the current $I_1$ to be output from the power source 31 is so controlled as to satisfy the following condition:

$$I_4=I_1-I_2I_3$$

In operation, the charger 12 uniformly charges the surface of the drum 10 while the exposing unit scans the charged surface of the drum 10 with an optical signal L. As a result, a latent image is electrostatically formed on the drum 10. The developing unit 13 develops the latent image with toner to thereby produce a corresponding toner image. In the illustrative embodiment, use is made of toner chargeable to negative polarity and containing styrene-acryl as a parent material. The bias roller 30 forms an electric field in the image transfer region where the belt 21 faces the drum 10. Consequently, the toner image is transferred from the drum 10 the paper sheet P. Subsequently, a fixing unit, not shown, fixes the toner image on the paper sheet P. After the image transfer, the cleaning unit 15 removes the toner left on the drum 10. The discharger 16 discharges the so cleaned surface of the drum 10 in order to prepare it for the next image formation.

Figure 2:
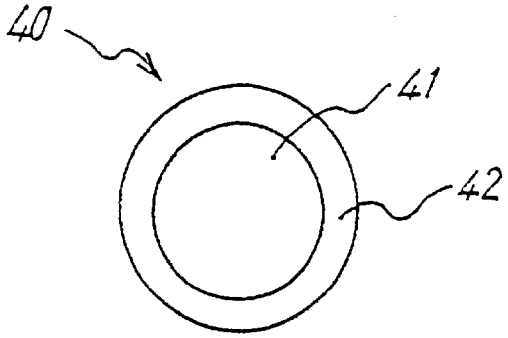
FIG. 2 is a section showing a cleaning roller included in the illustrative embodiment.

How the belt 21 is cleaned will be described specifically hereinafter. As shown in FIG. 1, the cleaning roller 40 cleans the surface of the belt 21. FIG. 2 shows a specific configuration of the cleaning roller 40. As shown, the cleaning roller 40 is made up of a metallic core 41 and an about 100 μm thick dielectric layer 42 covering the core 41. In the illustrative embodiment, the dielectric layer or elastic layer 42 is implemented by a tube formed of a nylon-containing material in which carbon black is dispersed as a resistance control agent. The cleaning roller 40 bites in to the belt 21 by about 1 mm and rotates in a direction indicated by an arrow in FIG. 1 at the same speed as the belt 21.

In the illustrative embodiment, the cleaning roller 40 is a hard roller including the metallic core 41. Alternatively, use may be made of a soft cleaning roller whose core is formed of an elastic material, in which case the roller will face the drive roller 22 or an exclusive counter member, not shown, in such a manner as to bite into the belt 21. Further, whether the cleaning roller 40 may be hard or soft, an exclusive counter member may be used to press the belt 21 against the cleaning roller 40 in contact with the inner surface of the belt 21.

In operation, toner left on the belt 21 after image transfer and charged to negative polarity is brought into contact with the dielectric layer 42 of the cleaning roller 40. As a result, a positive charge opposite in polarity, to the charge of the toner is induced on the surface of the dielectric layer 42 due to dielectric polarization, causing electrostatic attraction to act between the dielectric layer 42 and the toner. At this instant, the toner forming layers between the belt 21 and the dielectric layer 42 are subjected to the above attraction (dielectric body attraction hereinafter) and electrostatic attraction acting between the belt 21 and the toner (belt attract ion hereinafter). However, the sizes of the attraction acting on the toner each are inversely proportional to the square of a distance to the toner. Therefore, the dielectric body attraction acts on the toner existing in the upper layer portion on the surface of the belt 21 more intensely than the belt attraction. It follows that the toner in the upper layer portion moves toward the dielectric layer 42 away from the belt 21. Further, even the toner inverted in polarity moves toward the dielectric layer 42 away form the belt 21 because the surface of the layer 42 is constantly charged to the polarity opposite to the polarity of the toner. A rubber blade 44 scrapes off the toner collected by the cleaning roller 40.

Figure 3:
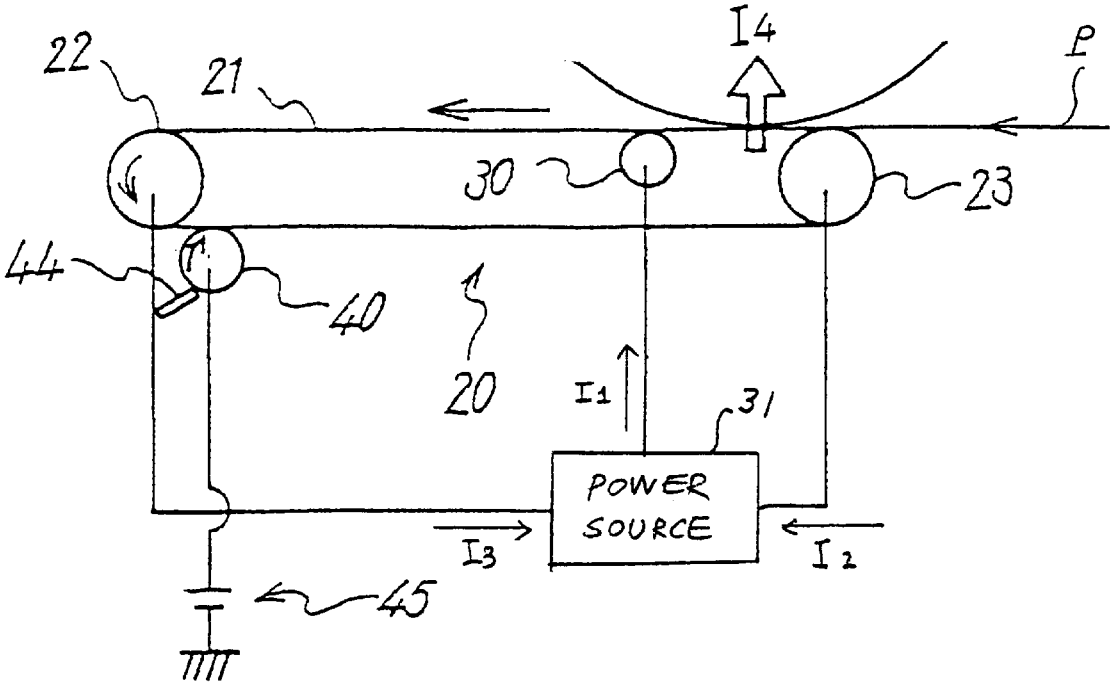
FIG. 3 is a view showing a modified form of an image transferring device included in the illustrative embodiment.

To further promote the movement of the toner from the belt 21 to the dielectric layer 42, bias applying means may be added to the arrangement shown in FIG. 1. In such a case, the bias applying means will apply a positive cleaning bias, which is opposite in polarity to the charge of the toner, to the cleaning roller 40. FIG. 3 shows another specific configuration of the image transferring device 20 including the above bias applying means.

As shown in FIG. 3, the bias applying means is implemented by a constant-voltage power source 45 connected to the core 41 of the cleaning roller 40. The power source 45 applies, e.g., a bias of +400 V to the cleaning roller 40. The bias applying means 45 assigned to belt cleaning is independent of the bias applying means 31 assigned to image transfer. Alternatively, to control the current 14 to flow to the drum 10 more accurately, the bias applying means or constant-current power source 31 may play the role of the bias applying means 45 at the same time.

In the configuration shown in FIG. 3, not only the dielectric body attraction is maintained, but also a bias electric field extending toward the cleaning roller 40 acts on the toner due to a potential difference between the roller 40 and the belt 21. In this condition, the toner on the belt 21 partly moves to the surface of the dielectric layer 42 due to the electrostatic force and partly moves to the same due to the bias electric field. In this manner, the dielectric attraction and the electrostatic force derived from the electric field cooperate to remove more toner from the belt 21 and thereby clean the surface of the belt 21 more efficiently. It is noteworthy that the dielectric layer 42 forming the surface of the cleaning roller 40 prevents the cleaning bias from being injected into the toner and inverting the polarity of the toner.

As for a frictional charge series, the dielectric layer 42 should preferably be formed of a material capable of charging the toner to preselected polarity that forms a toner image, i.e., negative polarity in the illustrative embodiment. A nylon-containing. material, used in the illustrative embodiment as such a material, intensifies the negative charge deposited on the toner that contacts the dielectric layer 42. This is successful to make the cleaning bias more effective and therefore to promote more efficient cleaning. Moreover, the tube formed of the nylon-containing material is durable and low cost.

A resistance control agent should preferably be dispersed in the dielectric layer 42 in order to control the resistance and specific inductive capacity of the layer 42. The resistance control agent protects the surface of the dielectric layer 42 from charging ascribable to the contact of the layer 42with the belt 21. This kind of charging would make the attraction acting between the layer 42 and the toner excessive or would cause it to change into a repulsive force. The resistance control agent therefore insures a desirable cleaning ability, and in addition facilitates the collection of the toner from the cleaning roller 40 to occur later. Carbon black, used in the illustrative embodiment as a resistance control agent, has another advantage that it charges a minimum amount of toner to the unexpected polarity in the aspect of frictional charge series.

As stated above, even when the belt 21 has high resistance or when a great amount of charge deposits on the toner, the illustrative embodiment is capable of cleaning the surface of the belt 21 more efficiently than the conventional electric field type of cleaning means. Further, the illustrative embodiment is capable of removing even the toner inverted in polarity from the belt 21 and protects the belt 21 from defective cleaning which would bring about the offset of a recording medium or defective image transfer. Desirable images are therefore achievable with the illustrative embodiment.

Experiments were conducted to prove the advantages of the illustrative embodiment. Specifically, the copier of the illustrative embodiment was operated to produce 10,000 copies (size A4, landscape position) with the cleaning roller 40 cleaning the surface of the belt 21. Toner left on the belt 21 was transferred to a colorless, transparent adhesive tape. Subsequently, the optical density (ID) of the toner on the adhesive tape was measured by a Macbeth densitometer. When the bias was not applied to the cleaning roller 40, the optical density was as high as about 0.6 to about 0.7. A bias of +400 V was successful to lower the optical density to 0.02. For comparison, a metallic clean ing roller lacking the dielectric layer 42 was mounted on the image transferring device 20 and operated in the same manner as in the illustrative embodiment for cleaning the belt 21. The resulting optical density was as high as 1.3 despite the application of the bias of +400 V. The experiments therefore showed that a desirable cleaning ability was achievable with the cleaning roller 40.

In summary, it will be seen that the present invention provides an image forming apparatus and an image transferring device having various unprecedented advantages, as enumerated below.

(1) Even when a belt for image transfer has high resistance or when a great amount of charge deposits on toner, the present invention is capable of cleaning the surface of the belt more efficiently than the conventional electric field type of cleaning means. Further, the present invention is capable of removing even toner inverted in polarity from the belt.

(2) An electrostatic force derived from a bias electric field serves to clean the surface of the belt more efficiently.

(3) The bias electric field, which is formed by bias applying means and opposite in polarity to the charge of toner, acts on the toner more effectively and further enhances the cleaning ability.

(4) A dielectric layer is protected from charging. This kind of charging would make attraction acting between the dielectric layer and the toner excessive or would cause it to change into a repulsive force. It is therefore possible to maintain a desirable cleaning ability and to facilitate the collection of the toner from a cleaning member.

(5) The present invention insures desirable images by protecting the belt from defective cleaning that would bring about the offset of a recording medium or defective image transfer.

Various modifications will become possible for those skilled in the art after receiving the teachings of the present disclosure without departing from the scope thereof.

What is claimed is:

1. An image transferring device for transferring a toner image from an image carrier to a recording medium, said image transferring device comprising:

a belt formed of an elastic material and passed over a plurality of rotary bodies for supporting and conveying the recording medium; and a cleaning member for cleaning a surface of said belt in contact with said cleaning member and for biting into said belt by about 1 mm, wherein said cleaning member including a metallic core and only a dielectric layer outside of and directly contacting said metallic core, said dielectric layer forming a surface of said cleaning member.

2. The device as claimed in claim 1, further comprising a power source configured to apply a cleaning bias to said cleaning member opposite in polarity to a charge that deposits on toner for forming said toner image.

3. The device as claimed in claim 2, wherein said dielectric layer is formed of a material configured to charge, with respect to a frictional charge series, the toner to a preselected polarity that forms said toner image.

4. The device as claimed in claim 3, further comprising a resistance control agent dispersed in said dielectric layer.

5. The device as claimed in claim 2, further comprising a resistance control agent dispersed in said dielectric layer.

6. The device as claimed in claim 1, further comprising a resistance control agent dispersed in said dielectric layer.

7. An image forming apparatus comprising:

an image carrier;

a toner image device configured to form a toner image on said image carrier; and an image transferring device configured to transfer the toner image from said image carrier to a recording medium;

said image transferring device comprising:

a belt formed of an elastic material and passed over a plurality of rotary bodies for supporting and conveying the recording medium; and a cleaning member for cleaning a surface of said belt in contact with said cleaning member and for biting into said belt by about 1 mm, wherein said cleaning member including a metallic core and only a dielectric layer outside of and directly contacting said metallic core, said dielectric layer forming a surface of said cleaning member.

8. An image transferring means for transfer ring a toner image from an image carrier to a recording medium, said image transferring means comprising:

means for supporting and conveying the recording medium formed of an elastic material; and cleaning means for cleaning a surface of said means for supporting and conveying the recording medium in contact with said cleaning means and for biting into said belt by about 1 mm, wherein said cleaning means including a metallic core and only a dielectric layer outside of and directly contacting said metallic core, said dielectric layer forming a surface of said cleaning member.

9. The means as claimed in claim 8, further comprising bias applying means for applying to said cleaning means a cleaning bias opposite in polarity to a charge that deposits on toner for forming said toner image.

10. The means as claimed in claim 9, further comprising a resistance control means dispersed in said dielectric layer.

11. The means as claimed in claim 8, wherein said dielectric layer is formed of a material capable of charging, with respect to a frictional charge series, the toner to a preselected polarity that forms said toner image.

12. The means as claimed in claim 11, further comprising a resistance control means dispersed in said dielectric layer.

13. The means as claimed in claim 8, further comprising a resistance control means dispersed in said dielectric layer.

14. An image forming means comprising:

image carrier means;

toner image forming means for forming a toner image on said image carrier means; and image transferring means for transferring the toner image from said image carrier to a recording medium;

said image transferring device comprising:

means for supporting and conveying the recording medium formed of an elastic material; and a cleaning means for cleaning a surface of said belt in contact with said cleaning member and for biting into said belt by about 1 mm, wherein said cleaning means including a metallic core and only a dielectric layer outside of and directly contacting said metallic core, said dielectric layer forming a surface of said cleaning member.

* * * * *